US005499034A

United States Patent [19]

Fujii et al.

[11] Patent Number: 5,499,034

[45] Date of Patent: Mar. 12, 1996

[54] GLASS ANTENNA FOR AUTOMOTIVE VEHICLES

[75] Inventors: Hiroyuki Fujii; Junichiro Ieiri, both of Matsusaka, Japan

[73] Assignee: Central Glass Company, Limited, Ube, Japan

[21] Appl. No.: 233,656

[22] Filed: Apr. 26, 1994

[30] Foreign Application Priority Data

Apr. 30, 1993 [JP] Japan ..... 5-104712
Oct. 22, 1993 [JP] Japan ..... 5-265122

[51] Int. Cl.[6] ..... H01Q 1/32
[52] U.S. Cl. ..... 343/713; 343/828
[58] Field of Search ..... 343/828, 704, 343/713; H01Q 1/32

[56] References Cited

U.S. PATENT DOCUMENTS 4,791,425 12/1988 Yotsuya et al. ..... 343/713
5,101,212 3/1992 Shinnai et al. ..... 343/713

FOREIGN PATENT DOCUMENTS 62-26912 2/1987 Japan .
62-69704 3/1987 Japan .

*Primary Examiner*—Michael C. Wimer

[57] ABSTRACT

The invention provides a vehicle window glass antenna for transmission and reception of ultrashort waves used for mobile phones and radios for personal or business use. The antenna forms two classes. An antenna under one class comprises a first element consisting of a vertical conductive strip and a horizontal conductive strip connected to an end of the vertical conductive strip, and a second element consisting of a vertical conductive strip and a pair of horizontal conductive strips one of which is connected to an end of the vertical conductive strip of the second element. The horizontal conductive strips of the second element are disposed adjacently above and under the horizontal conductive strip of the first element so as to wrap around an end portion of the first element. The antenna under another class comprises a first element consisting of a first horizontal conductive strip having a feed point portion, a first vertical conductive strip connected to an end of the first horizontal conductive strip, a second horizontal conductive strip connected at an end to the first vertical conductive strip and extending away therefrom to have another end, a second vertical conductive strip connected to the other end of the second horizontal conductive strip, and a third vertical conductive strip located adjacent to the second vertical conductive strip and connected to the first horizontal conductive strip, and a second element similar to that of the antenna under the aforementioned class.

32 Claims, 12 Drawing Sheets

GLASS ANTENNA FOR AUTOMOTIVE VEHICLES

BACKGROUND OF THE INVENTION

1. Field of the Invention

The present invention relates in general to an antenna provided to a rear window glass of an automotive vehicle and, particularly to the kind suited for transmitting and receiving ultrashort waves allocated to mobile phones and radios for personal or business use installed on an automobile. The antenna is also suited for receiving TV (television) broadcast waves in UHF bands.

2. Background of the Invention

In current automobiles it is customary to use a pole antenna for the transmission and reception of ultrashort waves assigned to mobile phones and radios for personal or business use in Japan. However, the protrusions of a pole antenna from a car body is unfavorable for safety and also for good appearance of the car. Besides, pole antennas are obstructive to car washing and sometimes break.

There have been some proposals of providing an antenna for transmission and reception of ultrashort waves on an automobile window glass. See, for example, JP-A 62-69704 and JP-A (Utility Model) 62-26912. However, window glass antennas proposed until now are considerably low in transmission and reception gains when compared with conventional pole antennas and hence cannot be put into practical use for car telephones or radios for personal or business use.

SUMMARY OF THE INVENTION

According to an aspect of the present invention, there is provided an antenna attached to a vehicle window glass. The antenna comprises a first element consisting of a vertical conductive strip and a horizontal conductive strip connected to an end of the vertical conductive strip, and a second element consisting of a vertical conductive strip and a pair of horizontal conductive strips, one of which is connected to an end of the vertical conductive strip of the second element. The horizontal conductive strips of the second element are disposed .adjacently above and under the horizontal conductive strip of the first element so as to wrap around an end portion of the first element.

In a preferred embodiment, the horizontal conductive strip of the first element has a portion serving as a feed point. The length of the vertical conductive strip of the first element is equal to or larger than $(\lambda\alpha/4)(1-0.2)$ where $\lambda$ is wavelength of a transmitted or received radio wave and $\alpha$ is shortening coefficient of wavelength of glass, whilst the total length of the first element, which consists of the length of the vertical conductive strip and the length of a portion of the horizontal conductive strip between the vertical conductive strip and the feed point, is in the range of $(3\lambda\alpha/4)(1\pm0.2)$.

In another preferred embodiment, the aforementioned one horizontal conductive strip of the second element has a portion serving as a feed point. The length of the vertical conductive strip of the second element is equal to or larger than $(\lambda\alpha/4)(1-0.2)$ where $\lambda$ is wavelength of a transmitted or received radio wave and $\alpha$ is shortening coefficient of wavelength of glass, whilst the total length of the second element, which consists of the length of the vertical conductive strip and the length of a portion of the aforementioned one horizontal conductive strip between the vertical conductive strip and the feed point, is in the range of $(3\lambda\alpha/4)(1\pm0.2)$.

In a further preferred embodiment, the width of the horizontal conductive strip of the first element and the second element is in the range from 1 mm to 15 mm.

According to a further aspect of the present invention, an antenna comprises a first element consisting of a first horizontal conductive strip having a feed point portion, a first vertical conductive strip or a plurality of first vertical strips connected to an end of the first horizontal conductive strip, a second horizontal conductive strip connected at an end to the first vertical conductive strip or one of the first vertical conductive strips and extending away therefrom so as to have another end, a second vertical conductive strip connected to the other end of the second horizontal conductive strip, and a third vertical conductive strip located adjacent to the second vertical conductive strip and connected to the first horizontal conductive strip, and a second element consisting of a horizontal conductive strip and a vertical conductive strip connected to an end of the horizontal conductive strip. The horizontal conductive strip of the second element has a feed point portion located adjacent to the feed point portion of the first horizontal conductive strip of the first element. The antenna further comprises a coaxial cable having an inner conductor connected to one of the feed point portions of the first and second elements and an outer conductor connected to the other of the feed point portions of the first and second elements.

In a preferred embodiment, the length of a portion of the first horizontal conductive strip of the first element between the feed point portion and one of the first and third vertical conductive strips remoter from the feed point portion is equal to or larger than $(\lambda\alpha/4)(1-0.2)$ where $\lambda$ is wavelength of transmitted or received radio wave and $\alpha$ is a shortening coefficient of wavelength of glass, whilst the total length of the first element, which consists of the length of the remoter one of the first and third vertical conductive strips and the length of a portion of the first horizontal conductive strip between the feed point portion and the remoter one of the first and third vertical conductive strips, is in the range of $(3\lambda\alpha/4)(1\pm 0.2)$.

In another preferred embodiment, the length of the vertical conductive strip of the second element is equal to or larger than $(\lambda\alpha/4)(1-0.2)$ where $\lambda$ is wavelength of transmitted or received radio wave and $\alpha$ is shortening coefficient of wavelength of glass, whilst the total length of the Second element, which consists of the length of the vertical conductive strip and the length of a portion of the horizontal conductive strip between the vertical conductive strip and the feed point portion, is in the range of $(3\lambda\alpha/4)(1\pm0.2)$.

In a further preferred embodiment, the width of the horizontal conductive strip of the first element and the second element is in the range from 1 mm to 15 mm.

The glass antennas of,the above described patterns and dimensions are effective for solving the above noted problems inherent in the prior art glass antennas.

It is accordingly an object of the present invention to provide a novel and improved antenna for attachment to a vehicle window glass, particularly an automobile rear window glass, which can be put into practical use for car telephones or radios for personal or business use.

It is a further object of the present invention to provide a novel and improved antenna of the above described character which can attain marked improvement in transmission and reception gains.

It is a further object of the present invention to provide a novel and improved antenna of the above described character which can be used for receiving TV (television) broadcast waves in UHF bands.

DETAILED DESCRIPTION OF THE PREFERRED EMBODIMENTS

Figure 1:
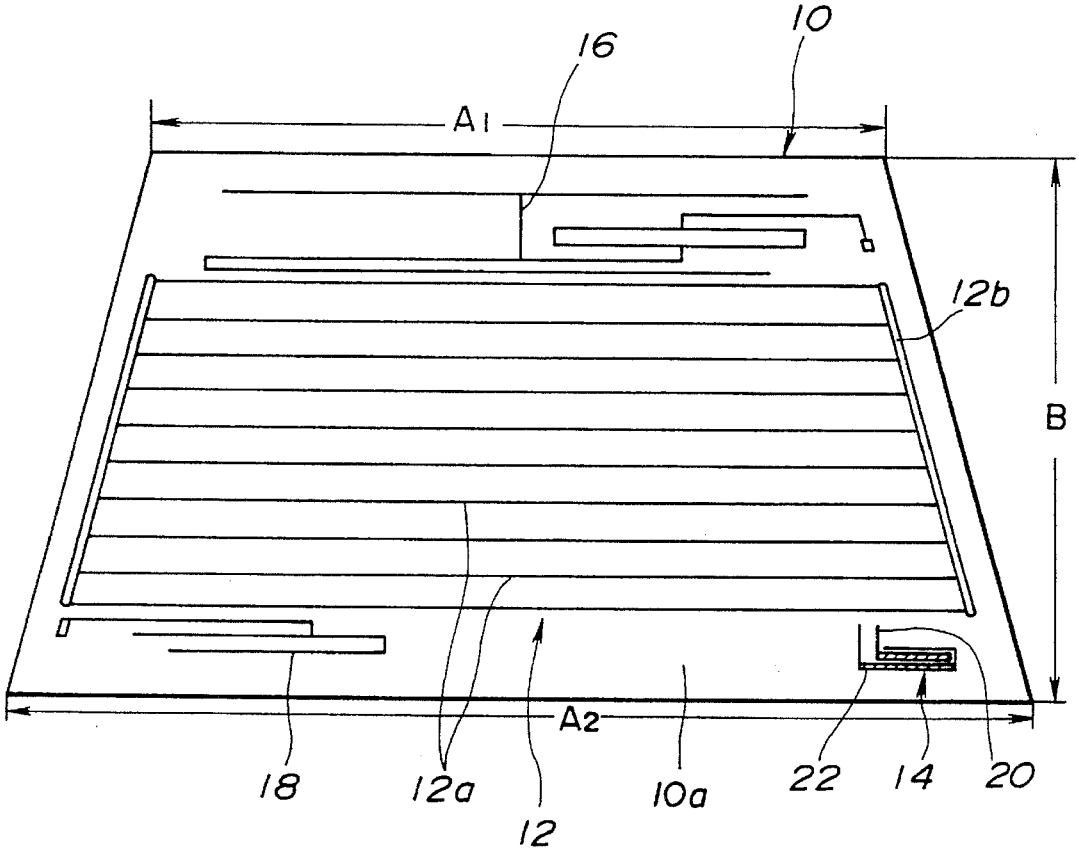
FIG. 1 is a plan view of an automobile rear window glass provided with an antenna according to an embodiment of the present invention.

Before describing the preferred embodiments in detail, the present invention will be described briefly. An important feature of the present invention resides in the discovery of particular patterns for arrangement of conductive strips of an antenna, which patterns can effect marked improvement in the transmission and reception gains of the antenna. That is, by the experiments conducted by the applicants, it was found that some antennas consisting of a plurality of conductive strips and having particular patterns can attain marked improvement in the transmission and reception gains.

Such antennas can be grouped into two classes.

An antenna under one class consists of first and second elements. The first element is made up of a vertical conductive strip and a horizontal conductive strip connected to a lower end of the vertical conductive strip. The second element is made up of a vertical conductive strip and a pair of horizontal conductive strips, one of which is connected to an end of the vertical conductive strip. The pair of horizontal conductive strips of the second element are disposed adjacently above and under the horizontal conductive strip of the first element so as to wrap around an end portion of the first element.

The reasons why such an antenna can effect marked improvement in the transmission and reception gains are considered to be as follows. The first element transmits and receives radio waves with vertical polarization for car telephones efficiently by the effect of its vertical conductive strip which is preferably of the length of $(\lambda\alpha/4)(1-0.2)$ or more wherein $\lambda$ is a wavelength of a transmitted or received radio wave and $\alpha$ is a shortening coefficient of a wavelength of glass. By adding the horizontal conductive to the first element and, preferably, by setting the total length of the first element to be in the range of $(3\lambda\alpha/4)(1\pm0.2)$, efficient supply of power to the first element can be obtained.

Further, the vertical conductive strip of the second element, which is preferably of the length of $(\lambda\alpha/4)(1-0.2)$ or more wherein $\lambda$ is a wavelength of a transmitted or received radio wave and $\alpha$ is a shortening coefficient of a wavelength of glass, transmits and receives radio waves for car telephones efficiently. When the total length of the second element having the horizontal conductive strip, in addition to the vertical conductive strip is particularly set to be in the range of $(3\lambda\alpha/4)(1\pm0.2)$, efficient supply of power to the second element can be attained.

Further, by arranging the two horizontal conductive strips of the second element adjacently above and under the horizontal conductive of the first element so as to wrap around the end portion of the first element, the antenna and the feeder can be matched in impedance to each other, enabling the antenna to transmit and receive radio waves for car telephones with efficiency.

Further, by making the horizontal conductive strips of the first and second elements have a wider width in the range from 1 mm to 15 mm, more preferably in the range from 3 mm to 10 mm, the antenna can be used for a wider frequency range of radio waves and therefore a wider band.

In the meantime, $\alpha$ is a shortening coefficient of wavelength of glass and determined to be about 0.6 for a frequency band in the range from 800 MHz to 900 MHz and about 0.5 for a frequency band around 1.5 GHz.

An antenna under another class also consists of a first element and a second element. The first element takes two forms.

One form of the first element consists of a first horizontal conductive strip, a first vertical conductive strip or a plurality of first vertical conductive strips connected to an end portion of the first horizontal conductive strip, a second horizontal conductive strip connected at an end to the first vertical conductive strip or one of the first vertical conductive strips and extending away therefrom to have another end, a second vertical conductive strip connected to the other end of the second horizontal conductive strip, and a third vertical conductive strip arranged adjacent the second vertical conductive strip and connected to the first horizontal conductive strip.

Another form of the first element consists of a first horizontal conductive strip, a first vertical conductive strip connected to an end portion of the first horizontal conductive strip, a second horizontal conductive strip connected at an end to the first vertical conductive strip and extending away therefrom so as to have another end, a second vertical conductive strip connected at an end to the other end of the second horizontal conductive strip and extending away therefrom to have another end adjacent the first horizontal conductive strip, and a third horizontal conductive strip connected to the other end of the second vertical conductive strip and extending away therefrom toward the first vertical conductive strip.

The second element consists of a vertical conductive strip and a horizontal conductive strip connected to a lower end of the vertical conductive strip. The horizontal conductive strip has a feed point portion adjacent to a feed point portion of the first horizontal conductive strip of the first element.

The first and second elements are connected by an inner conductor and an outer conductor of a coaxial cable, respectively.

The length of a portion of the first horizontal conductive strip of the first element between a feed point and one of the first or third vertical conductive strips remoter from the feed point is set to be equal to or larger than $(\lambda\alpha/4)(1-0.2)$ where $\lambda$ is a wavelength of a transmitted or received radio wave and $\alpha$ is a shortening coefficient of a wavelength of glass. Further, the total length of the first element consisting of the length of the remoter one of the first or third vertical conductive strips and the length of a portion of the horizontal conductive strip between the feed point and the remoter one of the first or third vertical conductive strips is set to be in the range of $(3\lambda\alpha/4)(1\pm 0.2)$.

Further, the length of the vertical conductive strip of the second element is set to be equal to or larger than $(\lambda\alpha/4)(1-0.2)$ where $\lambda$ is a wavelength of a transmitted or received radio wave and $\alpha$ is a shortening coefficient of a wavelength of glass, whilst the total length of the second element consisting of the length of the vertical conductive strip and the length of a portion of the horizontal conductive strip between the vertical conductive strip and the feed point is set to be in the range of $(3\lambda\alpha/4)(1\pm 0.2)$.

The reasons why such an antenna can effect marked improvement in transmission and reception gain are considered to be as follows. The first element transmits and receives radio waves with vertical polarization for car telephones efficiently by the effect of its vertical conductive strip or strips located remoter from the feed point. By adding the horizontal conductive to the first element and particularly by setting the total length of the first element to be in the range of $(3\lambda\alpha/4)(1\pm 0.2)$ where $\lambda$ is wavelength of transmitted or received radio wave and $\alpha$ is shortening coefficient of wavelength of glass, efficient supply of power to the first element can be attained.

Further, the vertical conductive strip of the second element transmits and receives radio waves for car telephones efficiently. When the total length of the second element having the horizontal conductive strip in addition to the vertical conductive strip is particularly set to be in the range of $(3\lambda\alpha/4)(1\pm 0.2)$, efficient supply of power to the second element can be attained.

Further, by connecting the first vertical conductive strip of the first element with the second horizontal conductive strip extending side by side with the first horizontal conductive strip and by connecting the end of the second horizontal conductive strip with the second vertical conductive strip whilst connecting to the first horizontal conductive strip the third horizontal conductive strip located close to the second vertical conductive strip, or by connecting the first vertical conductive strip with the second horizontal conductive strip whilst connecting an end of the second horizontal conductive strip with the second vertical conductive strip and then connecting to the end of the second vertical conductive strip the third horizontal conductive strip extending toward the first vertical conductive strip, the antenna and the feeder can be matched in impedance to each other, making it possible for the antenna to transmit and receive radio waves for car telephones efficiently.

Further, by making the horizontal conductive strips of the first and second elements have a wider width in the range from 1 mm to 15 mm, more preferably in the range from 3 mm to 10 mm, the antenna can be used for a wider frequency range of radio waves and therefore a wider band.

Figure 2:
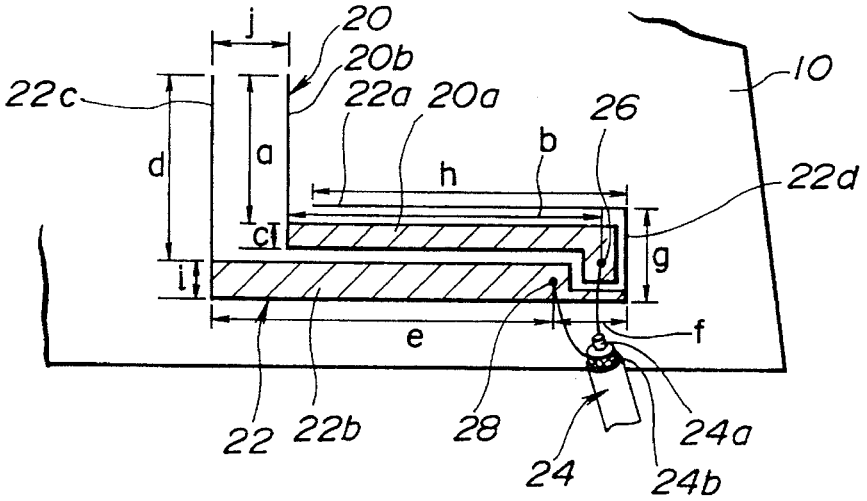
FIG. 2 is an enlarged view of the antenna in FIG. 1.

Referring to FIGS. 1 and 2, a rear window glass 10 of an automobile is formed from a single piece of glass plate and has on the inboard surface thereof a defogging electric heater element 12 so as to leave an open space 10*a* around the heater element 12. The heater element 12 consists of a plurality of horizontal heater strips 12*a* and a pair of vertical bus bars 12*b* between which the horizontal heater strips 12*a* extends.

An antenna according to the present invention is indicated by 14 and disposed on the inboard surface of the window glass 10 and in the space 10*a* around the heater element 12 together with conventional antennas 16 and 18. The antenna 14 consists of a first element 20 and a second element 22. The first element 20 consists of a horizontal conductive strip 20*a* and a vertical conductive strip 20*b* and formed into an L-like shape. The second element 22 consists of a pair of horizontal strips 22*a* and 22*b*, a first vertical strip 22*c* and a second vertical conductive strip 22*d*. The horizontal conductive strips 22*a* and 22*b* are disposed adjacently above and under the horizontal conductive strip 20*a* of the first element 20. The second vertical strip 22*d* connects between one ends of the horizontal conductive strips 22*a* and 22*b* so that the conductive strip 22*a*, 22*b* and 22*d* wrap around an end portion of the first element 20. The first vertical strip 22*c* is connected to the other end of the lower horizontal conductive strip 22*b* which is longer than the upper horizontal conductive strip 22*a* so as to extend upwardly therefrom.

The antenna 14 is formed on the window glass 10 together with the heater element 12 and the conventional antennas 16 and 18 by screen-printing a conductive paste onto the window glass 10 and baking the printed paste.

After the window glass 10 is installed in place on a vehicle body (not shown), an end portion 26 of the first element 20 and an end portion 28 of the second element 22 are connected to an inner conductor 24*a* and an outer conductor 24*b* of a coaxial cable 24, respectively. The end portions 26 and 28 thus serve as the respective feed points of the first and second elements 20 and 22.

Various parts of the antenna 14 are of such dimensions that A1=1150 mm, A2=1320 mm, B=760 mm, a=60 mm, b=85 mm, c=3 mm, d=70 mm, e=90 mm, f= 20 mm, g=20 mm, h=83 mm, i=10 mm, j=25 mm, the distance between the horizontal conductive strip 20*a* of the first element 20 and the upper horizontal conductive strip 22*a* of the second element 22 is 5 mm, and the distance between the horizontal conductive strip 20*a* of the first element 20 and the lower horizontal conductive strip 22*b* of the second element 22 is 3 mm.

With such an automotive glass antenna of FIGS. 1 and 2, gains in transmitting and receiving radio waves with vertical polarization and in the frequency band from 800 MHz to 900 MHz for car telephones in North America were measured and expressed by the difference in gain between the antenna of this embodiment and a standard pole antenna of a car telephone on the assumption that the gain of the pole antenna in transmission and reception is zero (hereinafter the difference is referred to as a pole ratio). The result was that the average of the gains in various directions was −1.3 dB. From this result, the antenna of this embodiment can be judged to be sufficiently efficient and comparable to the conventional pole antenna. In the meantime, since the center frequency of the transmitted or received radio waves in this embodiment is 850 MHz, $\lambda$ is about 353 mm and $\alpha$ is determined to be 0.6. Thus, $\lambda\alpha/4$ is about 53 mm, $(\lambda\alpha/4)(1-0.2)$ is about 42 mm, and $(3\lambda\alpha/4)(1\pm0.2)$ is in the range from about 127 mm to 191 mm. Both of the length "a" of the vertical conductive strip 20*b* of the first element 20 and the length "d" of the vertical conductive strip 22*c* of the second element 22 are longer than $(\lambda\alpha/4)(1-0.2)$. Further, the total length (a+b) of the first element 20 consisting of the length "a" of the vertical conductive strip 20*b* and the length "b" between the vertical conductive strip 20*b* and the feed point 26 is 145 mm, whilst the total length (d+e) of the second element 22 consisting of the length "d" of the vertical conductive strip 22*c* and the length "e" between the vertical conductive strip 22*c* and the feed point 28 is 160 mm. So, both of the total lengths of the first and second elements 20 and 22 are within the range of $(3\lambda\alpha/4)(1\pm0.2)$.

Figure 3:
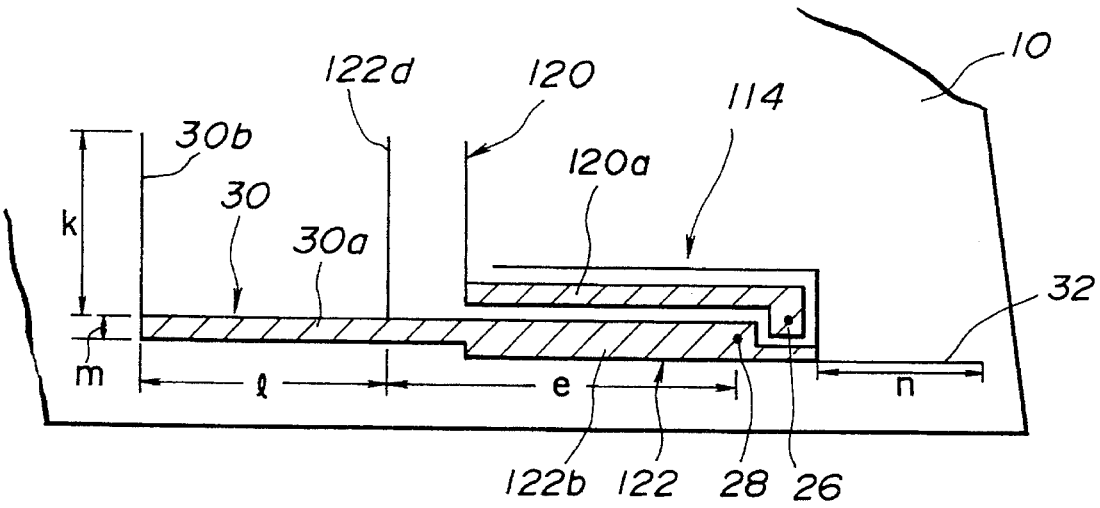
FIGS. 3 to 5 are views similar to FIG. 2 but shows further embodiments.

FIG. 3 shows a glass antenna 114 according to a further embodiment. In this embodiment, the horizontal conductive strip 122*b* of the second element 122 is constructed so as to have a larger width of 10 mm at a portion extending side by side with the horizontal conductive strip 120*a* of the first element 120 and a smaller width of 5 mm at a portion extending therefrom to the vertical conductive strip 122*d*. The antenna 114 is provided with an auxiliary element 30 having an L-like shape and consisting of a horizontal conductive strip 30*a* of the length (l) of 65 mm and of the width (m) of 5 mm and extending consecutively and away from the horizontal conductive strip 122*b* and a vertical conductive strip 30*b* of the length (k) of 70 mm and connected to the horizontal conductive strip 30*a*. The antenna 114 is further provided with an auxiliary element 32 in the form of a horizontal line or wire and connected to an end of the horizontal conductive strip 122*b* of the second element 122 opposite to the end thereof connected with the auxiliary element 30 and extending away therefrom. Except for the above, this embodiment is substantially similar to the previous embodiment of FIGS. 1 and 2.

With such an automotive glass antenna of FIG. 3, gains in transmitting and receiving radio waves with vertical polarization and in the frequency band from 800 MHz to 900 MHz for car telephones in North America were measured. The result was that the average of the gains was −0.9 dB. Accordingly, the result obtained by this embodiment was the more favorable than that by the previous embodiments of FIGS. 1 and 2.

Figure 7:
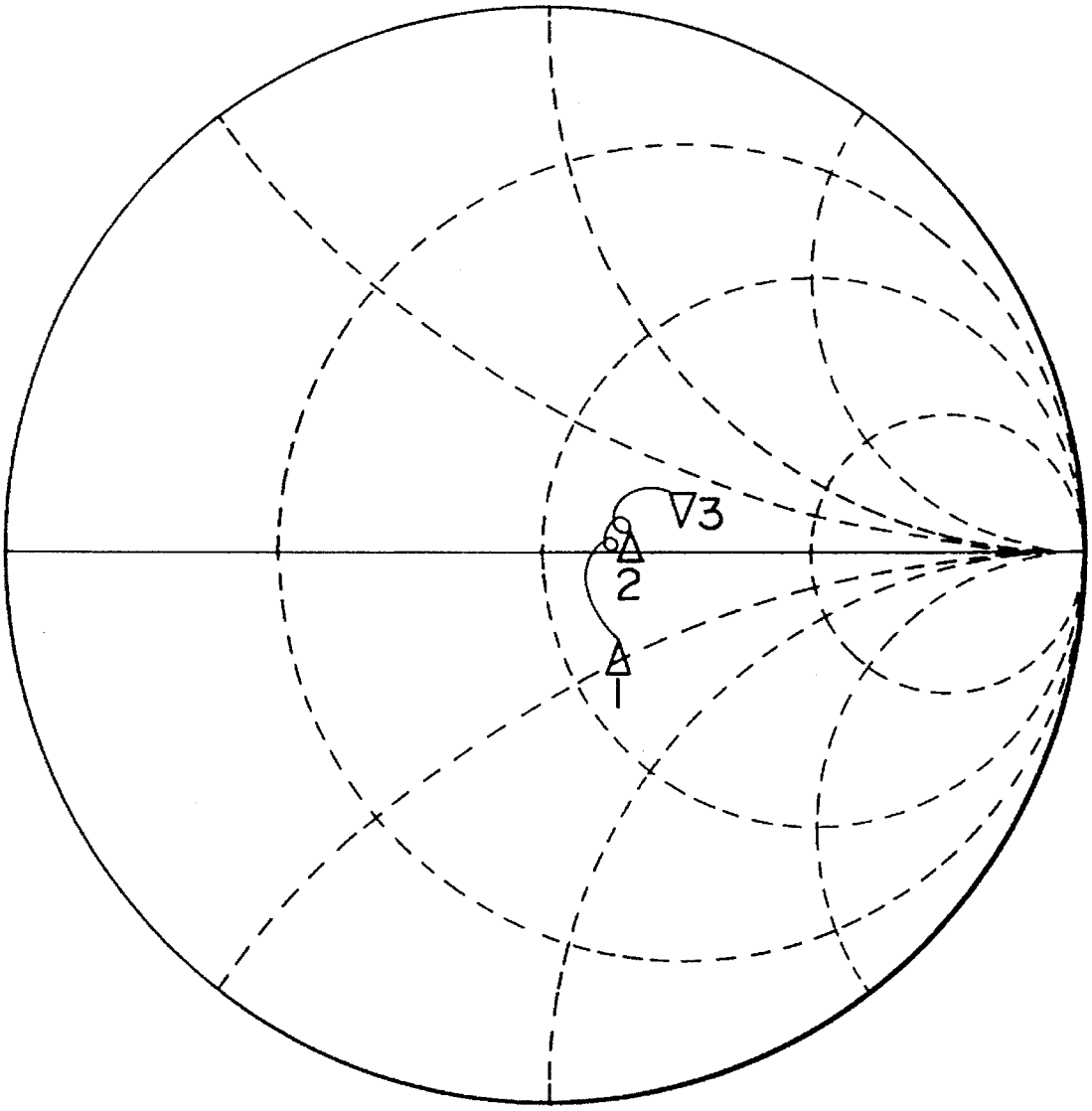
FIG. 7 is a Smith chart for illustrating the impedance of the antenna in FIG. 3, in which the mark "1" indicates a frequency of 800 MHz, the mark "2" indicates a frequency of 850 MHz and the mark "3" indicates a frequency of 900 MHz.

Further, the impedance of the antenna 114 of this embodiment was measured and such a result shown in FIG. 7 was obtained. As will be apparent from this result, not only the marks "1", "2" and "3" indicating 800 MHz, 850 MHz and 900 MHz, respectively, but the intervening areas of the marks are concentrated within a zone adjacent the characteristic impedance of the coaxial cable, that is, 50 Ω in this embodiment, so it will be understood that a quite favorable impedance characteristic is obtained by this embodiment.

In the meantime, while the total length (k+l+ e) consisting of the length (k+l) of the auxiliary element 30 and the length (e) of a portion of the horizontal conductive strip 122*b* of the second element 122 between the vertical conductive strip 122*d* and the feed point 28 is 225 mm and therefore out of the range of $(3\lambda\alpha/4)(1\pm0.2)$, the element 30 is not a part of the second element 122 but is considered as an auxiliary element.

Figure 4:
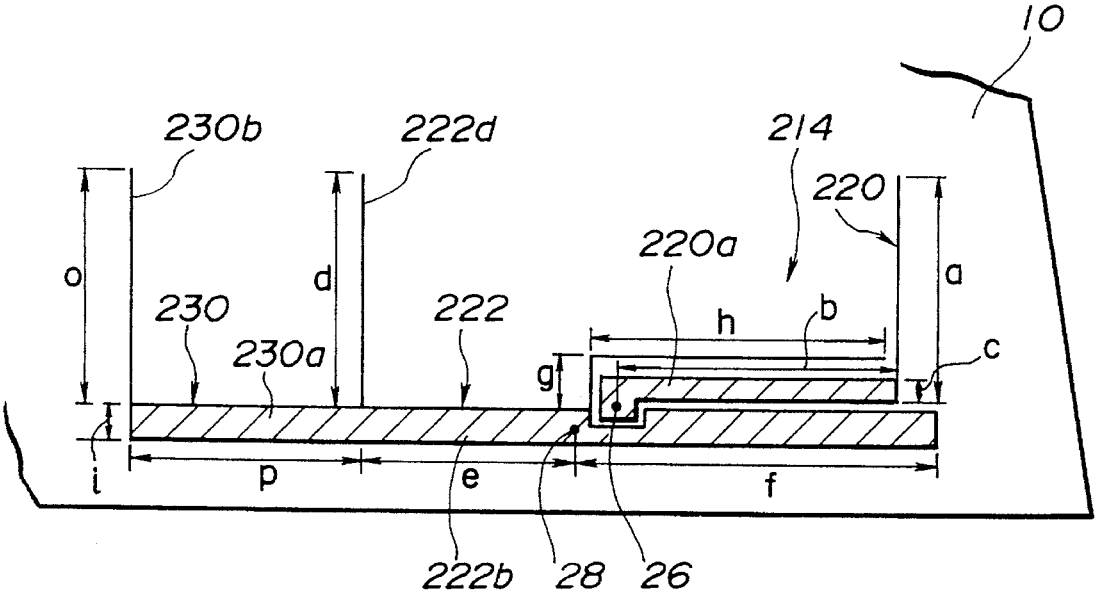

FIG. 4 shows an automotive glass antenna 214 according to a further embodiment. In this embodiment, the first element 220 is formed into such a shape that is symmetrical to the L-like shape about a vertical line. The lower horizontal conductive strip 222*b* of the second element 222 consists of a portion of the length (f) and extending generally side by side with the horizontal portion 220*a* of the first element 220, and an extension portion of the length (e) extending consecutively from the above described portion of the length (f). Various parts of the antenna 214 are of such dimensions that a=65 mm, b=85 mm, c=3 mm, d= 70 mm, e=100 mm, f=90 mm, g=15 mm, h=83 mm and i= 5 mm. The antenna 214 is provided with an auxiliary antenna 230 having an L-like shape and consisting of a horizontal conductive strip 230*a* of the length (p) of 75 mm and a vertical conductive strip 230*b* of the length (o) of 65 mm. The horizontal conductive strip 230*a* is equal in width to the horizontal conductive strip 222*b* of the second element 222.

With such an antenna 214 of FIG. 4, gains in transmitting and receiving radio waves with vertical polarization and in the frequency band from 800 MHz to 900 MHz for car telephones in North America were measured. The result was that the average of the gains was −1.0 dB. Accordingly, the result obtained by this embodiment was the more favorable than that by the previous embodiments of FIGS. 1 and 2.

Figure 8:
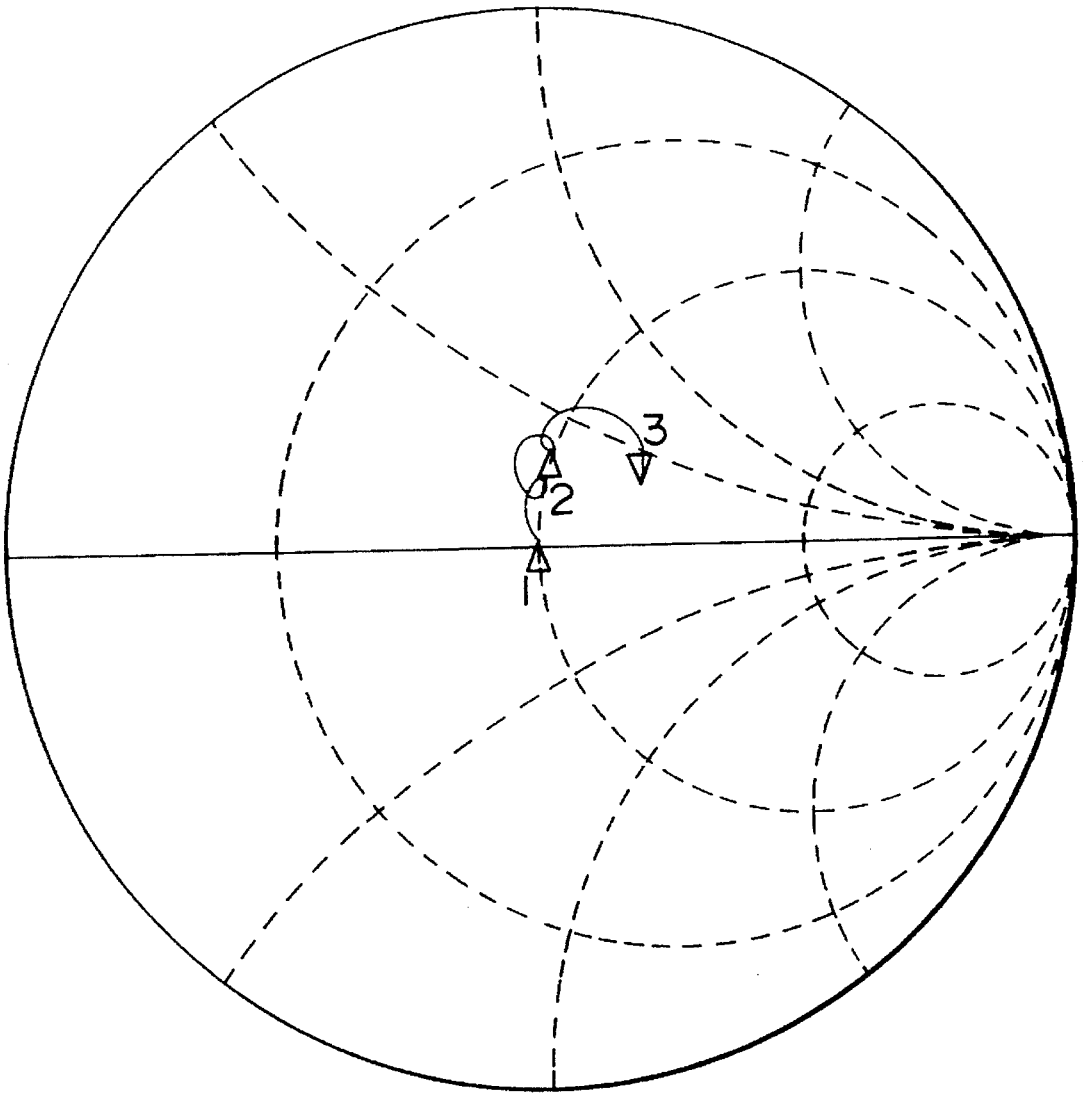
FIG. 8 is a Smith chart for illustrating the impedance of the antenna in FIG. 4, in which the mark "1" indicates a frequency of 800 MHz, the mark "2" indicates a frequency of 850 MHz and the mark "3" indicates a frequency of 900 MHz.

Further, the impedance of the antenna 214 of this embodiment was measured and such a result shown in FIG. 8 was obtained. As will be apparent from this result, not only the marks "1", "2" and "3" indicating 800 MHz, 850 MHz and 900 MHz, respectively, but the intervening areas of the marks are concentrated within a zone adjacent the characteristic impedance of the coaxial cable, that is, 50 Ω in this embodiment, so it will be understood that a quite favorable impedance characteristic is obtained by this embodiment.

In the meantime, a ,portion of the horizontal conductive strip 222*b* indicated by the length (f) is arranged so as to extend side by side with the horizontal conductive strip 220*a* of the first element 220. Further, the total length (d+e) of the second element 222 consisting of the length (d) of the vertical conductive strip 222*d* and the length (e) between the vertical conductive strip 222*d* and the feed point 28 is 170 mm. So, the horizontal conductive strip 222*b* and the vertical conductive strip 222*d* are considered as constituting the second element 222. The element 230 consisting of the horizontal conductive strip 230*a* and the vertical conductive strip 230*b* does not constitute a second element but an auxiliary element since the total length (o+p+e) amounts to 240 mm and is outside the range of $(3\lambda\alpha/4)(1\pm0.2)$.

Figure 5:
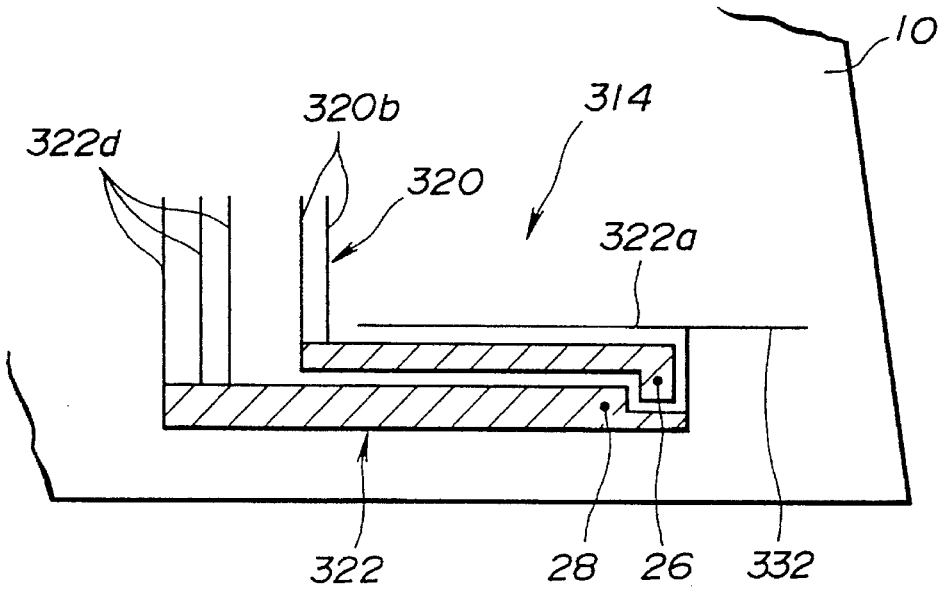

FIG. 5 shows a glass antenna 314 according to a further embodiment. In this embodiment, the first element 320 is provided with two vertical conductive strips 320*b* which are arranged adjacent to each other. The second element 322 is provided with three vertical conductive strips 322*d* which are arranged adjacent to each other. Further, the antenna 314 is provided with an auxiliary antenna 332 in the form of a horizontal line or wire and extended away from the upper horizontal conductive strip 322*a* of the second element 322. Except for the above, this embodiment is substantially similar and of the same dimensions to the previous embodiment of FIGS. 1 and 2. By the experiments conducted by the applicants, it was recognized that a favorable result was obtained by the antenna of this embodiment similarly to the previous embodiment of FIGS. 1 and 2.

Figure 6:
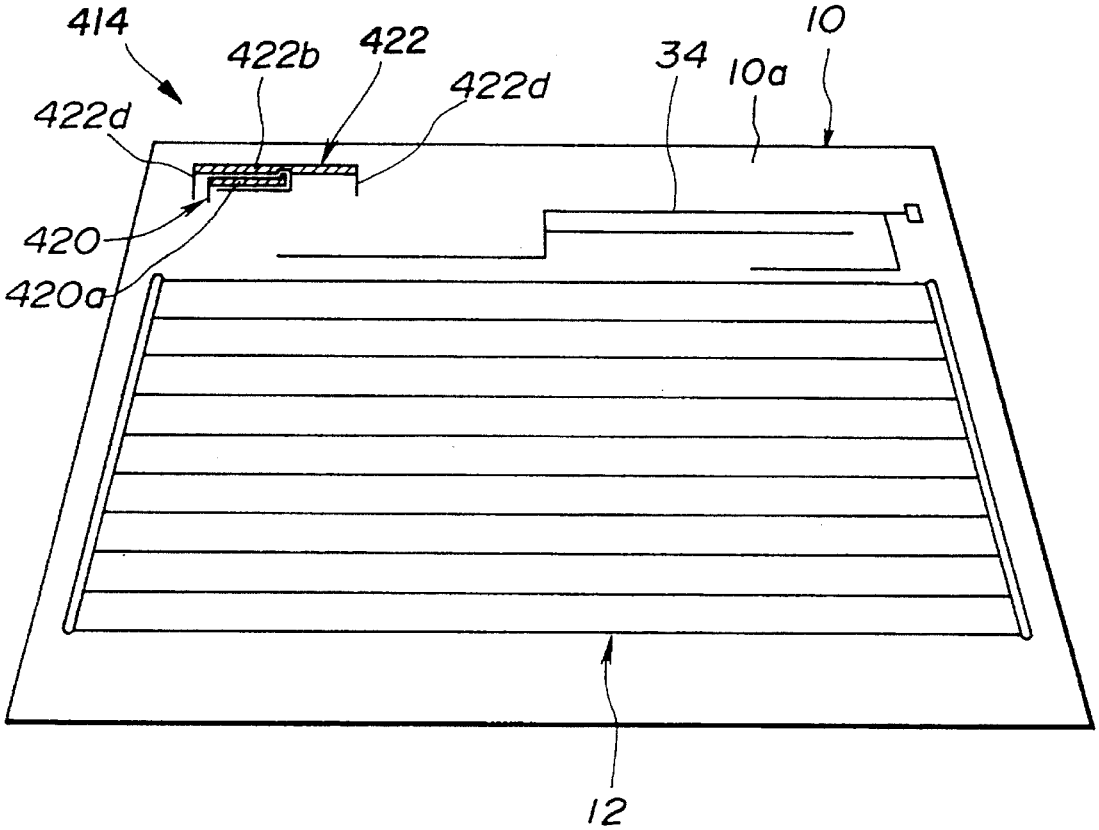
FIG. 6 is a view similar to FIG. 1 but shows a further embodiment.

FIG. 6 shows an antenna 414 according to a further embodiment. The antenna 414 is disposed in an area of the space 10*a* above the heater element 12 together with a conventional antenna 34. In this embodiment, the upper horizontal conductive strip 422*b* of the second element 422 consists of a portion generally extending side by side with the horizontal conductive strip 420*a* of the first element 420 and an extended portion extending away therefrom. The second element 422 has two vertical conductive strips 422*d* connected to the opposite ends of the horizontal conductive strip 422*b*, respectively. By the experiments conducted by the applicant, it was recognized that a favorable result can be obtained by this embodiment similarly to the previous embodiment of FIGS. 1 and 2.

Figure 9:
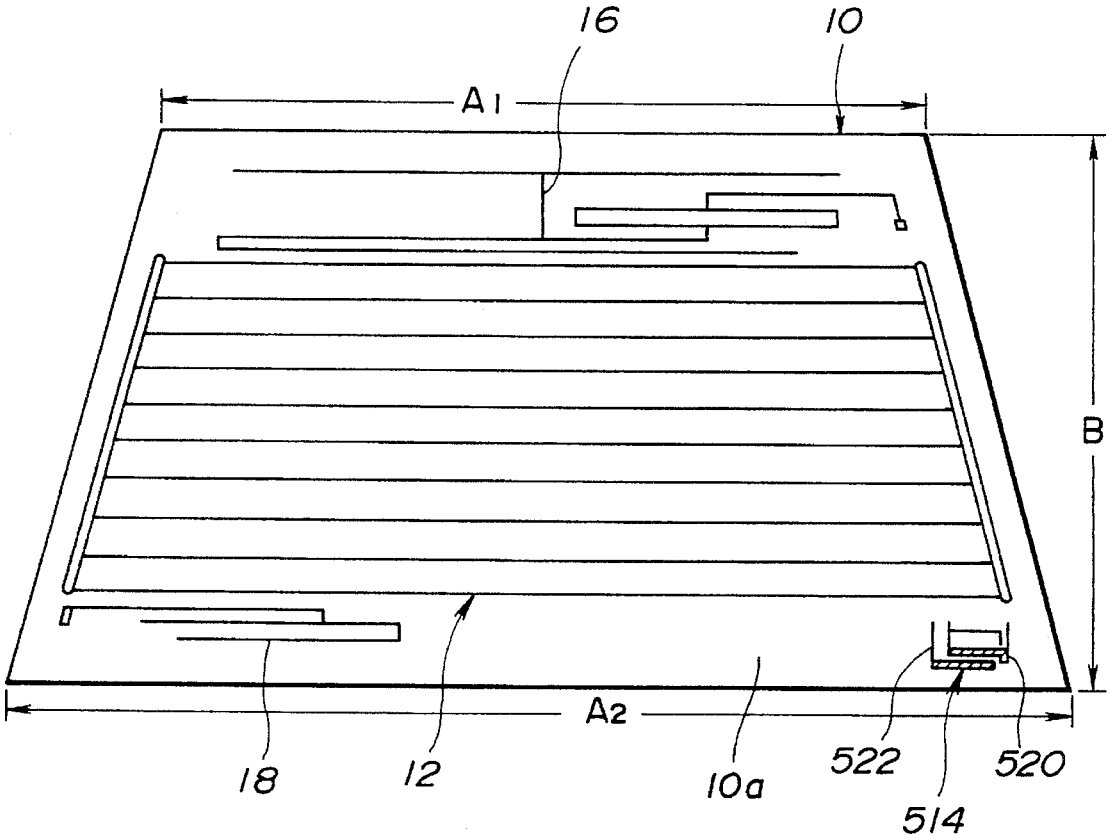
FIG. 9 is a plan view of an automobile rear window glass provided with an antenna according to a further embodiment of the present invention.
Figure 10:
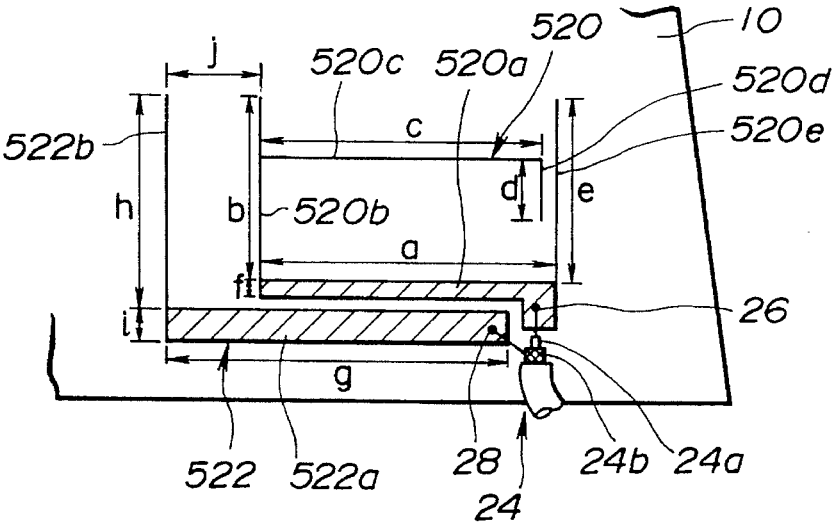
FIG. 10 is an enlarged view of the antenna in FIG.

Referring to FIGS. 9 and 10, an antenna according to a further embodiment is indicated by 514 and disposed on the inboard surface of the window glass 10 and in the space 10*a* around the heater element 12 together with conventional antennas 16 and 18. The antenna 514 consists of a first element 520 and a second element 522. The first element 520 consists of a first horizontal conductive strip 520*a*, a first vertical conductive strip 520*b* connected at a lower end thereof to an end of the first horizontal conductive strip 520*a*, a second horizontal conductive strip 520*c* connected at one end to the first vertical conductive strip 520*b* at a portion intermediate between the opposite ends thereof, a second vertical conductive strip 520*d* connected at an upper end thereof to the other end of the second horizontal conductive strip 520*c*, and a third vertical conductive strip 520*e* disposed adjacent to the second vertical conductive strip 520*d* and connected at the lower end thereof to the other end of the first horizontal conductive strip 520*a*. The second element 522 consists of a horizontal conductive strip 522*a* and a vertical conductive strip 522*b* and formed into an L-like shape. The horizontal conductive strip 522*a* is disposed adjacently under the first horizontal conductive strip 520*a* of the first element 520 so as to generally extend side by side therewith.

The antenna 514 is formed on the window glass 10 together with the heater element 12 and the conventional antennas 16 and 18 by screen-printing a conductive paste onto the window glass 10 and baking the printed paste.

After the window glass 10 is installed in place on a vehicle body (not shown), an end portion 26 of the first element 520 and an end portion 28 of the second element 522 are connected to an inner conductor 24*a* and an outer conductor 24*b* of a coaxial cable 24, respectively. The end portions 26 and 28 thus serve as the respective feed points of the first and second elements 520 and 522.

Various parts of the antenna 14 are of such dimensions that A1=1150 mm, A2=1320 mm, B=760 mm, a=83 mm, b=60 mm, c=80 mm, d=20 mm, e=60 mm, f= 3 mm, g=100 mm, h=70 mm, i=10 mm, j=25 mm, and the distance between the first horizontal conductive strip 520*a* of the first element 520 and the horizontal conductive strip 522*a* of the second element 522 is 3 mm.

With such an automotive glass antenna of FIGS. 9 and 10, gains in transmitting and receiving radio waves with vertical polarization and in the frequency band from 800 MHz to 900 MHz for car telephones in North America were measured and expressed by the difference in gain between the antenna of this embodiment and a standard pole antenna of a car telephone on the assumption that the gain of the pole antenna in transmission and reception is zero (hereinafter the difference is referred to as a pole ratio). The result was that the average of the gains in various directions was −1.0 dB. From this result, the antenna of this embodiment can be judged to be sufficiently efficient and comparable to the conventional pole antenna.

Figure 16:
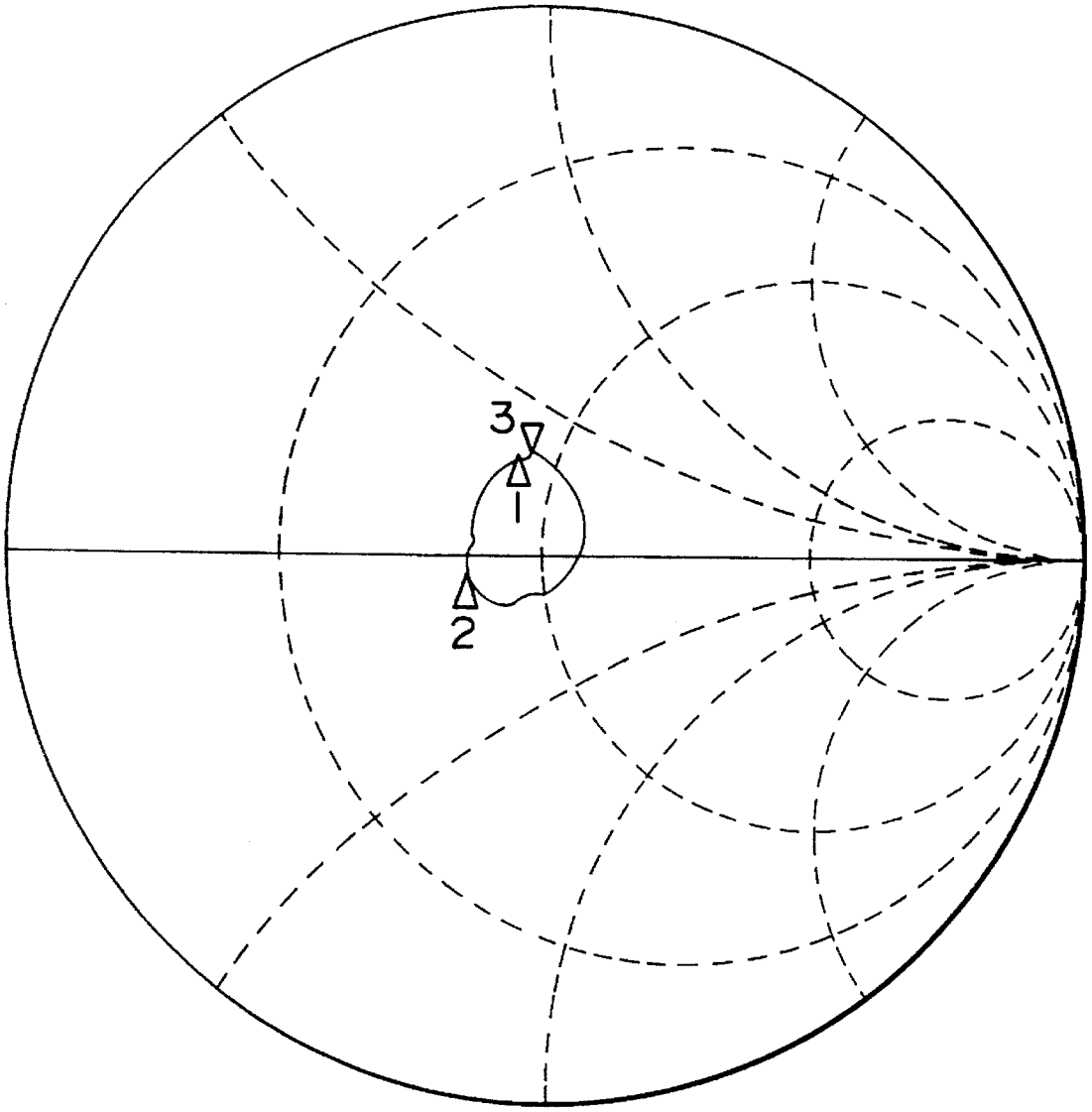
FIG. 16 is a Smith chart for illustrating the impedance of the antenna in FIGS. 9 and 10, in which the mark "1" indicates a frequency of 800 MHz, the mark "2" indicates a frequency of 850 MHz and the mark "3" indicates a frequency of 900 MHz.

Further, the impedance of the antenna 514 of this embodiment was measured and such a result shown in FIG. 16 was obtained. As will be apparent from this result, not only the marks "1", "2" and "3" indicating 800 MHz, 850 MHz and 900 MHz, respectively, but the intervening areas of the marks are concentrated within a zone adjacent the characteristic impedance of the coaxial cable, that is, 50 Ω in this embodiment, so it will be understood that a quite favorable impedance characteristic is obtained by this embodiment.

In the meantime, since the center frequency of the transmitted or received radio waves in this embodiment is 850 MHz, λ is about 353 mm and α is determined to be 0.6. Thus, λα/4 is about 53 mm, (λα/4)(1−0.2) is about 42 mm and (3λα/4) (1±0.2) is in the range from about 127 mm to 191 mm. Both of the length (b) of the first vertical conductive strip 520*b* of the first element 20 and the length (h) of the vertical conductive strip 522*b* of the second element 522 are longer than (λα/4) (1−0.2). Further, the total length (=a+b) of a L-like portion of the first element 520 consisting of the length (b) of the first vertical conductive strip 520*b* and the length (a) between the first vertical conductive strip 520*b* and the feed point 26 is about 143 mm, whilst the total length (=h+g) of the second element 522 consisting of the length (h) of the vertical conductive strip 522*b* and the length (g) between the vertical conductive strip 522*b* and the feed point 28 is about 170 mm. So, both of the total lengths of the L-like portions of the first element 520 and the second elements 522 are within the range of (3λα/4)(1±0.2).

Figure 11:
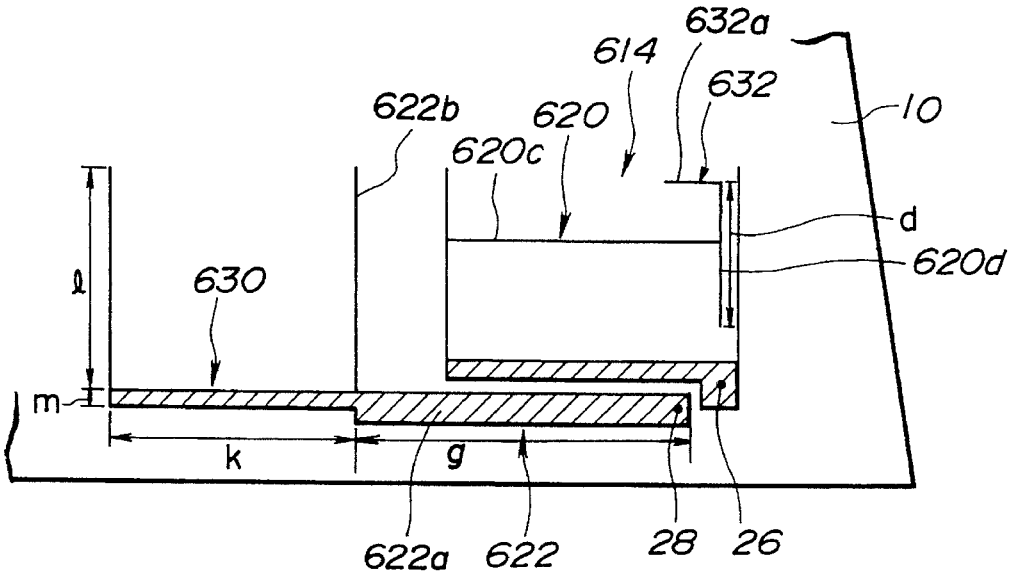
FIGS. 11 to 14 are views similar to FIG. 10 but shows further embodiments.

FIG. 11 shows a glass antenna 614 according to a further embodiment. In this embodiment, the third vertical conductive strip 620*d* is connected at an intermediate portion thereof to the end of the second horizontal conductive strip 620*c* and sized to be 50 mm long (i.e., d=50 mm). The antenna 614 is provided with an auxiliary element 632 consisting of a horizontal conductive strip 632*a* of the length of 20 mm and connected to the upper end of the second vertical conductive strip 620*d*. The antenna 614 is further provided with an auxiliary antenna 630 having an L-like shape and consisting of a horizontal conductive strip of the length (k) of 65 mm and a vertical conductive strip of the length (l) of 70 mm. The horizontal conductive strip of the auxiliary element 630 is of the width (m) of 5 mm and extended consecutively from the end of the horizontal conductive strip 622*a* of the second element 622 provided with the vertical conductive strip 622*b*. Except for the above, this embodiment is substantially similar to the previous embodiment of FIGS. 9 and 10.

With such a glass antenna of FIG. 11, gains in transmitting and receiving radio waves with vertical polarization and in the frequency band from 800 MHz to 900 MHz for car telephones in North America were measured. The result was that the average of the gains was −0.8 dB. Accordingly, the result obtained by this embodiment is the more favorable than that by the previous embodiments of FIGS. 9 and 10.

Figure 17:
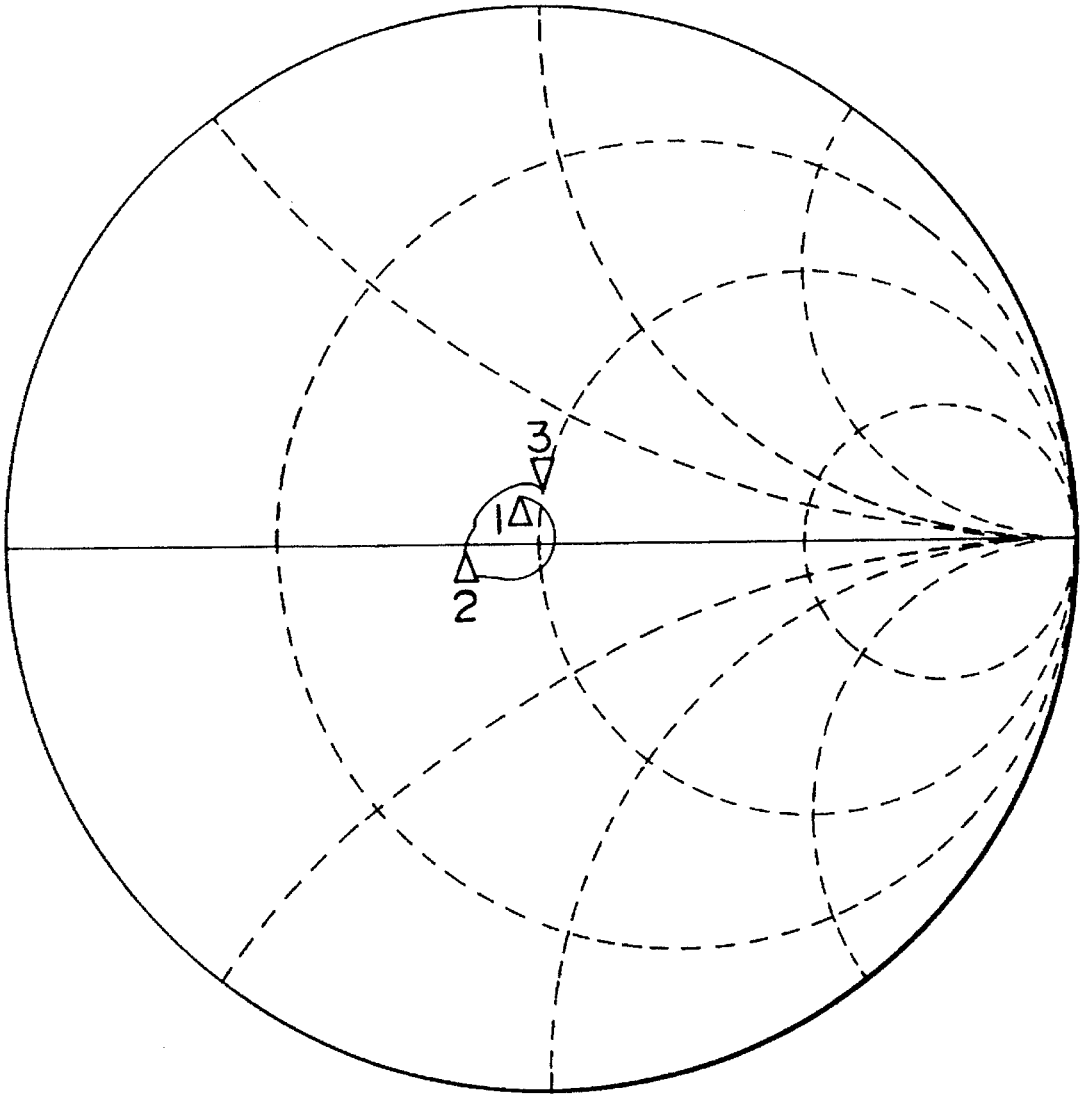
FIG. 17 is a Smith chart for illustrating the impedance of the antenna in FIG. 11, in which the mark "1" indicates a frequency of 800 MHz, the mark "2" indicates a frequency of 850 MHz and the mark "3" indicates a frequency of 900 MHz.

Further, the impedance of the antenna 614 of this embodiment was measured and such a result shown in FIG. 17 was obtained. As will be apparent from this result, not only the marks "1", "2" and "3" indicating 800 MHz, 850 MHz and 900 MHz, respectively, but the intervening areas of the marks are concentrated within a zone adjacent the characteristic impedance of the coaxial cable, that is, 50 Ω in this embodiment, so it will be understood that a quite favorable impedance characteristic is obtained by this embodiment.

In the meantime, while the total length (k+l+ g) comprising the length (k+l) of the auxiliary element 630 and the length (g) of the horizontal conductive strip 622*a* of the second element 622 is 235 mm and therefore out of the range of (3λα/4)(1±0.2), the element 630 is not a part of the second element 622 but is considered as an auxiliary element.

Figure 12:
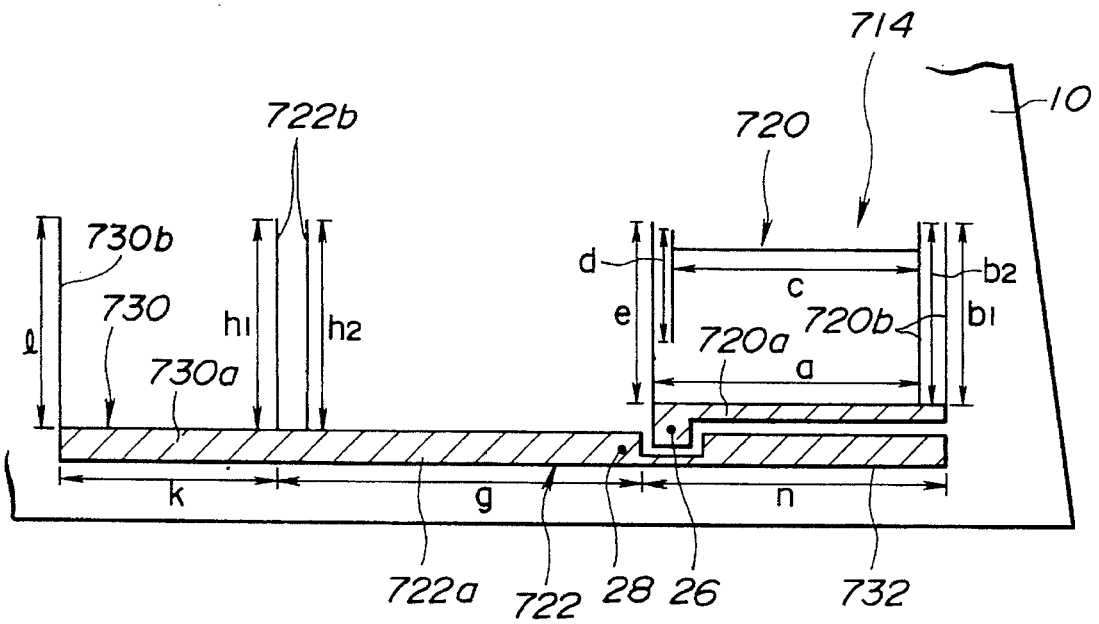

FIG. 12 shows a glass antenna 714 according to a further embodiment. In this embodiment, the feed point 26 of the first element 720 is provided to the different end portion of the first horizontal conductive strip 720*a* as compared the previous embodiment of FIGS. 9 and 10. The first element 720 is provided with two of the first vertical conductive strips 720*b*. The horizontal conductive strip 722*a* of the second element 722 is not arranged adjacent to and side by side with the first horizontal conductive strip 720*a* of the first element 720. The second element 722 is provided with two of the vertical conductive strips 722*b*.

The various parts of the glass antenna 714 are of such dimensions that a=85 mm, b1=b2=65 mm, c=75 mm, d=37 mm, e=65 mm, g=100 mm, and h1=h2=70 mm.

The antenna 714 is provided with an auxiliary element 730 having an L-like shape and consisting of a horizontal conductive strip 730*a* of the length (k) of 60 mm and a vertical conductive strip 730*b* of the length (l) of 65 mm. The auxiliary element 730 is connected to the second element 722 in such a manner that the horizontal conductive strip 730*a* of the auxiliary element 730 is extended consecutively from the first horizontal conductive strip 722*a* of the second element 722.

The antenna 714 is provided with another auxiliary element 732 consisting of a horizontal conductive strip of the length (n) of 90 mm.

Except for the above, this embodiment is substantially similar to the previous embodiment of FIGS. 9 and 10.

With such a glass antenna of FIG. 12, gains in transmitting and receiving radio waves with vertical polarization and in the frequency band from 800 MHz to 900 MHz for car telephones in North America were measured. The result was that the average of the gains was −1.0 dB. Accordingly, the result obtained by this embodiment is equal to that by the previous embodiments of FIGS. 9 and 10.

Figure 18:
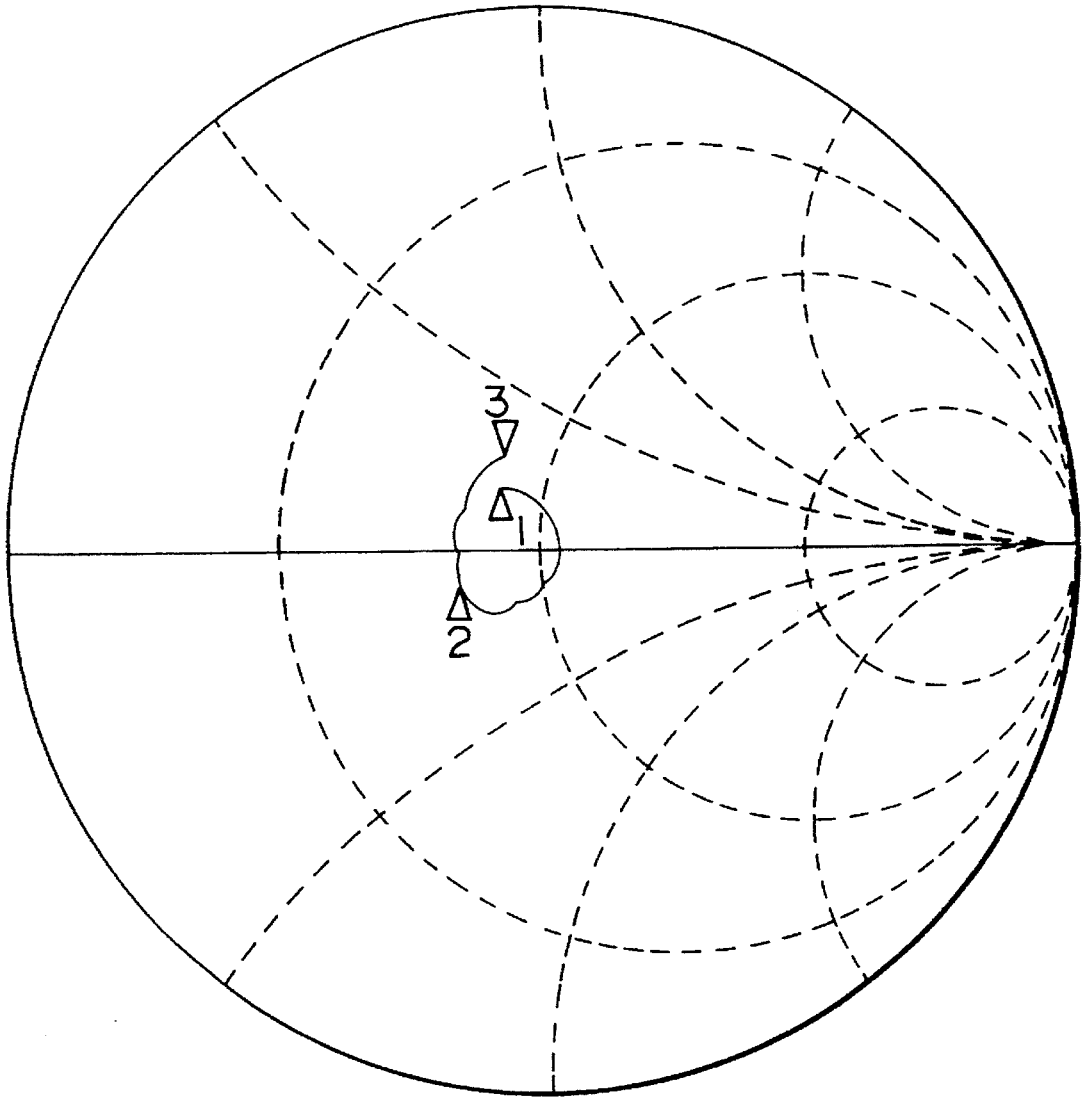
FIG. 18 is a Smith chart for illustrating the impedance of the antenna in FIG. 12, in which the mark "1" indicates a frequency of 800 MHz, the mark "2" indicates a frequency of 850 MHz and the mark "3" indicates a frequency of 900 MHz.

Further, the impedance of the antenna 714 of this embodiment was measured and such a result shown in FIG. 18 was obtained. As will be apparent from this result, not only the marks "1", "2" and "3" indicating 800 MHz, 850 MHz and 900 MHz, respectively, but the intervening areas of the marks are concentrated within a zone adjacent the characteristic impedance of the coaxial cable, that is, 50 Ω in this embodiment, so it will be understood that a quite favorable impedance characteristic is obtained by this embodiment.

In the meantime, since the total length (=h1+g) of the second element 722 consisting of the length (h1) of the vertical conductive strip 722*b* and the length of a portion of the horizontal conductive strip 722*a* between the vertical conductive strip 722*b* and the feed point 28 is about 170 mm and therefore within the range of $(3\lambda\alpha/4)(1\pm0.2)$, the element 722 is considered as a second element. On the other hand, since the total length (k+l+g) consisting of the length (k+l) of the auxiliary element 730 and the length (g) of the horizontal conductive strip 722*a* of the second element 722 is out of the range of $(3\lambda\alpha/4)(1\pm0.2)$, the element 730 is not a part of the second element 722 but is considered as an auxiliary element.

Figure 13:
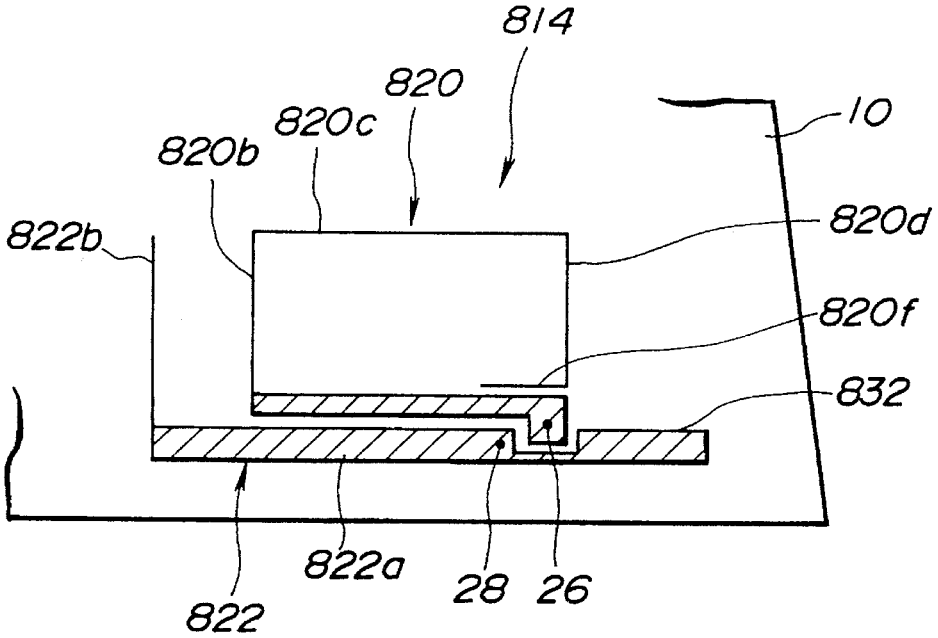

FIG. 13 shows an antenna 814 according to a further embodiment. In this embodiment, a horizontal conductive strip 820*f* is connected at an end to the lower end of the second vertical conductive strip 820*d* of the first element 820 in such a manner as to extend toward the first vertical conductive strip 820*b*. The second horizontal conductive strip 820*c* is connected to the upper end of the first vertical conductive strip 820*b*. The second horizontal conductive strip 820*c* is connected at an end to the upper end of the second vertical conductive strip 820*d*. The first element 820 is not provided with any other vertical conductive strip adjacent the second vertical conductive strip 820*d*. The second element 822 is provided with an auxiliary element 832 made up of a horizontal conductive strip and extended consecutively from an end of the horizontal conductive strip 822*a* opposite to an end connected with the vertical conductive strip 822*b*.

Except for the above, this embodiment is substantially similar to the previous embodiment of FIGS. 9 and 10 and can produce substantially the same effect.

Figure 14:
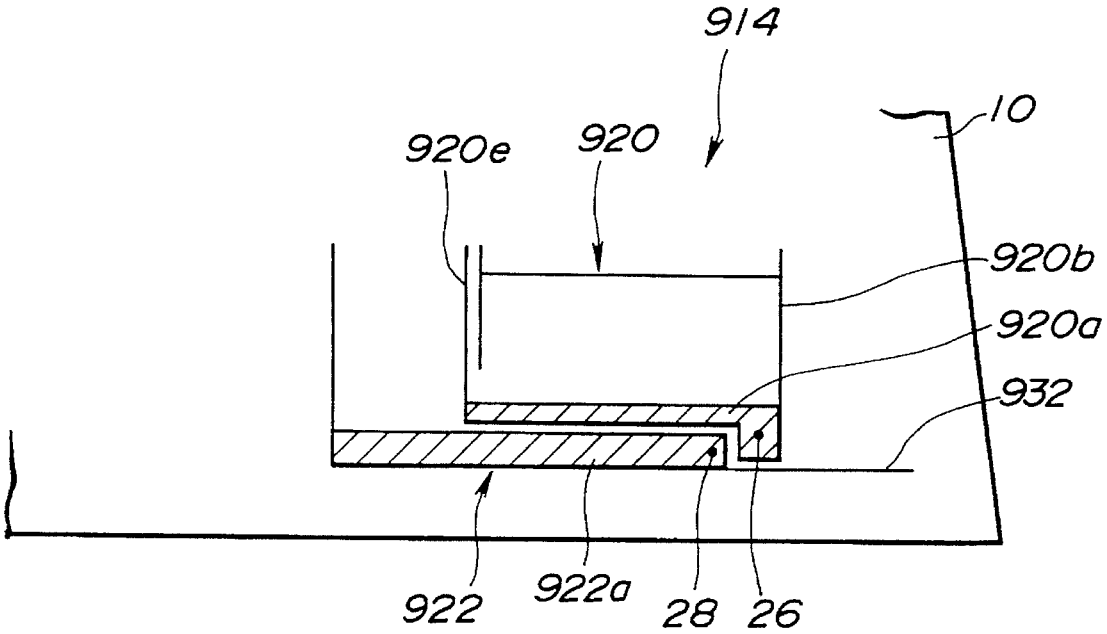

FIG. 14 shows an antenna 914 according to a further embodiment. In this embodiment, the first vertical conductive strip 920*b* of the first element 920 is provided to an end of the horizontal conductive strip 920*a* where the feed point 26 is provided. The third vertical conductive strip 920*e* is provided to an end of the horizontal conductive strip 920*a* opposite to the end where the feed point 26 is disposed. The second vertical conductive strip of the first element 920, though not designated, is disposed adjacent the third vertical conductive strip 920*e*. The second element 922 is provided with an auxiliary element 932 consisting of a horizontal conductive strip and extended consecutively from the horizontal conductive strip 922*a* thereof.

Except for the above, this embodiment is substantially the same as the previous embodiment of FIGS. 9 and 10 and can produce substantially the same effect.

Figure 15:
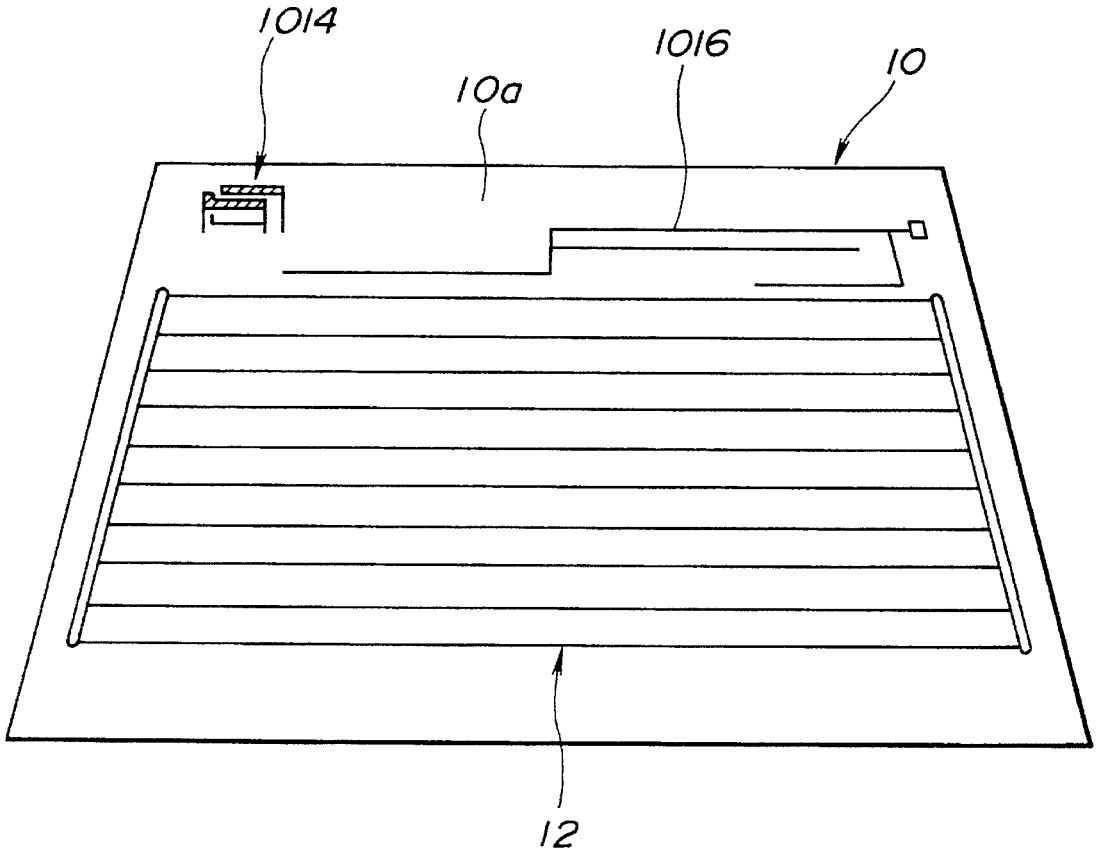
FIG. 15 is a view similar to FIG. 9 but shows a further embodiment.

FIG. 15 shows a glass antenna 1014 according to a further embodiment which is disposed in the open space 10*a* of the window glass 10 above the heater element 12 together with a conventional antenna 1016. The antenna 1014 is of such an arrangement that is obtained by inverting the arrangement of the antenna 514 in FIGS. 9 and 10. Except for the above, this embodiment is substantially similar to the previous embodiment of FIGS. 9 and 10 and can produce substantially the same effect.

In the foregoing, it is to be noted that, regarding the embodiments of FIGS. 1 to 6, a favorable result is obtained when the length of the vertical conductive strip of the first element is equal to or larger than $(\lambda\alpha/4)(1-0.2)$ where λ is wavelength of transmitted or received radio wave and α is shortening coefficient of wavelength of glass, whilst the total length of the first element comprising the length of the vertical conductive strip and the length of a portion of the horizontal conductive strip between the vertical conductive strip and the feed point is in the range of $(3\lambda\alpha/4)(1\pm0.2)$. The width of the horizontal conductive strip of the first element is preferably within the range from 1 mm to 15 mm and more preferably within the range from 3 mm to 10 mm.

It is further to be noted that, regarding the embodiments of FIGS. 1 to 6, a favorable result is obtained when the length of the vertical conductive strip of the second element is equal to or larger than $(\lambda\alpha/4)(1-0.2)$ where λ is wavelength of transmitted or received radio wave and α is shortening coefficient of wavelength of glass, whilst the total length of the second element comprising the length of the vertical conductive strip and the length of a portion of the horizontal conductive strip between the vertical conductive strip and the feed point is in the range of $(3\lambda\alpha/4)(1\pm0.2)$. The width of the horizontal conductive strip of the second element is preferably within the range from 1 mm to 15 mm and more preferably within the range from 3 mm to 10 mm.

It is further to be noted that, regarding the embodiments of FIGS. 9 to 15, while it is desirable to provide the horizontal conductive strip of the first element with one or a plurality of (up to about five) vertical conduct strips at an end opposite to the end provided having the feed point, the vertical conductive strip or strips may be provided to the end having the feed point.

It is further to be noted that, regarding the embodiments of FIGS. 9 to 12, 14 and 15 where a third vertical conductive strip is disposed adjacent to the second vertical conductive strip, it is desirable for the second and third vertical conductive strips to be constructed and arranged so as to extend side by side over the length of 20 mm or more.

It is further to be noted that, regarding the embodiment of FIG. 13 where the third horizontal conductive strip is connected to the second vertical conductive strip and located adjacent to the first horizontal conductive strip, it is desirable for the third horizontal conductive strip to be of the length equal to or more than 20 mm.

It is further to be noted that, regarding the embodiments of FIGS. 9 to 15, it is desirable that the length of each vertical conductive strip of the first element, which is provided the end of the horizontal conductive opposite to the end provided with the feed point, is equal to or larger than $(\lambda\alpha/4)(1-0.2)$ where $\lambda$ is a wavelength of transmitted or received radio wave and $\alpha$ is a shortening coefficient of a wavelength of glass whilst the total length of the first element, which consists of the length of the vertical conductive strip and the length of a portion of the horizontal conductive strip between the vertical conductive strip and the feed point, is in the range of $(3\lambda\alpha/4)(1\pm0.2)$. The width of the horizontal conductive strip of the first element is preferably within the range from 1 mm to 15 mm and more preferably within the range from 3 mm to 10 mm.

It is further to be noted that, regarding the embodiment of FIG. 12, in case an auxiliary element is arranged adjacent to and side by side with the first horizontal conductive strip of the first element, it is not necessarily needed to arrange the auxiliary element adjacent to the first horizontal conductive strip of the first element but it is desirable to do so since the open space of the glass occupied by the antenna can be smaller and there is a tendency that a higher reception gain is attained.

It is further to be noted that, regarding the embodiments of FIGS. 9 to 15, it is desirable that the length of the vertical conductive strip of the second element is equal to or larger than $(\lambda\alpha/4)(1-0.2)$ where $\lambda$ is a wavelength of a transmitted or received radio wave and $\alpha$ is a shortening coefficient of a wavelength of glass, whilst the total length of the second element comprising the length of the vertical conductive strip and the length of a portion of the horizontal conductive strip between the vertical conductive strip and the feed point is in the range of $(3\lambda\alpha/4)(1\pm0.2)$. The width of the horizontal conductive strip of the second element is preferably within the range from 1 mm to 15 mm and more preferably within the range from 3 mm to 10 mm.

It is further to be noted that while it is desirable to connect an inner conductor of a coaxial cable to the first element and an outer conductor to the second element, the inner and outer conductors may be reversely connected to the first and second elements.

It is further to be noted that the antenna of this invention may be disposed on a windshield glass, side window glass, etc. other than an open space of a rear window glass above or below a heater element.

It is further to be noted that the antenna of this invention is suited for transmitting and receiving ultrashort waves for radios for personal or business use and also for receiving TV broadcast waves in UHF band.

It is further to be noted that an auxiliary element is not necessarily needed for the antenna of this invention but may be provided in case of the necessity, in some kinds of automobiles, for improving the transmission and reception gain and the directivity characteristic.

While the glass antenna of this invention can be used singly, it can otherwise be used together with a glass antenna disposed on a windshield glass, a glass antenna disposed on a side window glass or a pole antenna to perform diversity reception and obtain a more favorable result.

Further, in case the rear window glass is to be formed from a laminated glass material, the glass antenna can be formed from thin metal wire such as copper wire which is embedded in an intermediate layer.

What is claimed is:

1. An antenna attached to a vehicle window glass, comprising:

a first element including a vertical conductive strip and a horizontal conductive strip connected to an end of said vertical conductive strip;

a second element including a vertical conductive strip and a pair of horizontal conductive strips connected to each other, one of said horizontal conductive strips of said second element being connected at an end thereof to an end of said vertical conductive strip of said second element, said horizontal conductive strips of said second element being disposed adjacently above and under said horizontal conductive strip of said first element, respectively, so that said second element wraps around an end portion of said first element; and a coaxial cable having an inner conductor and an outer conductor, said horizontal conductive strip of said first element having a portion serving as a feed point and connected at said portion serving as the feed point to one of said inner conductor and said outer conductor of said coaxial cable whilst one of said horizontal conductive strips of said second element has a portion serving as the feed point to the other of said inner conductor and said outer conductor of said coaxial cable.

2. An antenna according to claim 1, wherein said horizontal conductive strip of said first element has a portion serving as a feed point, said vertical conductive strip of said first element has a length which is no less than $(\lambda\alpha/4)(1-0.2)$, where $\lambda$ is a wavelength of a transmitted or received radio wave and $\alpha$ is a shortening coefficient of a wavelength of said glass, and a total length of said first element, including the length of said vertical conductive strip of said first element and the length of a portion of said horizontal conductive strip of said first element between said vertical conductive strip of said first element and said feed point of said first element, is in the range of $(3\lambda\alpha/4)(1\pm0.2)$.

3. An antenna according to claim 2, wherein the width of said horizontal conductive strip of said first element is in the range from 1 mm to 15 mm.

4. An antenna according to claim 1, wherein one of said horizontal conductive strips of said second element has a portion serving as a feed point, said vertical conductive strip of said second element has a length which is no less than $(\lambda\alpha/4)(1-0.2)$, where $\lambda$ is a wavelength of a transmitted or received radio wave and $\alpha$ is a shortening coefficient of a wavelength of said glass, and a total length of said second element, including the length of said vertical conductive strip of said second element and the length of a portion of said one of said horizontal conductive strips of said second element between said vertical conductive strip of said second element and said feed point being in the range of $(3\lambda\alpha/4)(1\pm0.2)$.

5. An antenna according to claim 4, wherein said one of said horizontal conductive strips of said second element has a width which is in the range from 1 mm to 15 mm.

6. An antenna attached to a vehicle window glass for transmitting and receiving ultrashort waves, the window glass being provided with a defogging heater element and the antenna being disposed in a space between the defogging heater element and a peripheral edge of the window glass, the antenna comprising:

a first element including a vertical conductive strip and a horizontal conductive strip connected to a lower end of said vertical conductive strip;

a second element including a first vertical conductive strip, first and second horizontal conductive strips, the first horizontal conductive strip of said second element being connected to an end of said first vertical conductive strip of said second element, and a second vertical conductive strip connecting said first and second horizontal conductive strips of said second element, said horizontal conductive strips of said second element being disposed adjacently above and under said horizontal conductive strip of said first element, respectively, so as to wrap around, together with said second vertical conductive strip, an end portion of said first element;

said horizontal conductive strip of said first element and said first horizontal conductive strip of said second element having feed point portions, respectively; and a coaxial cable having an inner conductor and an outer conductor one of which is connected to said feed point portion of said first element and the other of which is connected to said feed point portion of said second element.

7. An antenna according to claim 6, wherein the first horizontal conductive strip of said second element is located under said horizontal conductive strip of said first element, said horizontal conductive strip of said first element being connected at one of opposite ends thereof to said vertical conductive strip of said first element, said first horizontal conductive strip of said second element being connected at one of opposite ends thereof to said first vertical conductive strip of said second element, said one end of said horizontal conductive strip of said first element and said one end of said first horizontal conductive strip of said second element being located on one side of said second horizontal conductive strip of said second element.

8. An antenna according to claim 7, wherein the other of said opposite ends of said first horizontal conductive strip of said second element is connected to the other of said opposite ends of said second horizontal conductive strip of said second element by said second vertical conductive strip, said feed point portion of said first element is located adjacent to the other of said opposite ends of said horizontal conductive strip of said first element, and said feed point portion of said second element is located adjacent to the other end of said first horizontal conductive strip of said second element.

9. An antenna according to claim 8, and further comprising an auxiliary element of an L-shape and having a horizontal conductive strip extended consecutively from said first horizontal conductive strip of said second element.

10. An antenna according to claim 6, wherein said horizontal conductive strip of said first element is connected at one of opposite ends thereof to said vertical conductive strip and said first horizontal conductive strip of said second element is connected at one of opposite ends thereof to said first vertical conductive strip of said second element, said one end of said horizontal conductive strip of said first element and said one end of said first horizontal conductive strip of said second element being located on opposite sides of said second horizontal conductive strip of said second element, respectively.

11. An antenna according to claim 10, wherein said feed point portion of said first element is located adjacent to said one end of said horizontal conductive strip of said first element whilst said feed point portion of said second element is located intermediate between said opposite ends of said first horizontal conductive strip of said second element.

12. An antenna according to claim 6, wherein said first element comprises a plurality of said vertical conductive strips and said second element comprises a plurality of said first vertical conductive strips.

13. An antenna according to claim 6, wherein said first horizontal conductive strip of said second element is located above said horizontal conductive strip of said first element, said horizontal conductive strip of said first element being connected at one of opposite ends thereof to the vertical conductive strip of said first element, said first horizontal conductive strip of said second element being connected at one of opposite ends thereof to said first vertical conductive strip of said second element, said one end of said horizontal conductive strip of said first element and said one end of said first horizontal conductive strip of said second element being located on opposite sides of said second horizontal conductive strip of said second element.

14. An antenna according to claim 13, wherein said first element further comprises a second vertical conductive strip connected to said one end of said horizontal conductive strip of said first element.

15. An antenna attached to a vehicle rear window glass, comprising:

a first element including a first horizontal conductive strip having a feed point portion, a first vertical conductive strip connected to an end of said first horizontal conductive strip, a second horizontal conductive strip connected at an end to said first vertical conductive strip and extending away therefrom to have another end, a second vertical conductive strip connected to said another end of said second horizontal conductive strip, and a third vertical conductive strip located adjacent to said second vertical conductive strip and connected to said first horizontal conductive strip;

a second element including a horizontal conductive strip and a vertical conductive strip connected to an end of said horizontal conductive strip of said second element, said horizontal conductive strip of said second element having a feed point portion located adjacent to said feed point portion of said first horizontal conductive strip of said first element; and a coaxial cable having an inner conductor connected to one of said feed point portions of said first and second elements and an outer conductor connected to the other of said feed point portions of said first and second elements.

16. An antenna according to claim 15, wherein the length of one of said first and third vertical conductive strips of said first element remoter from said feed point portion of said first element is equal to or larger than $(\lambda\alpha/4)(1-0.2)$ where $\lambda$ is wavelength of transmitted or received radio wave and $\alpha$ is shortening coefficient of wavelength of glass, whilst the total length of said first element consisting of the length of said remoter one of said first and third vertical conductive strips and the length of a portion of said first horizontal conductive strip between said feed point portion and said remoter one of said first and third vertical conductive strips is in the range of $(3\lambda\alpha/4)(1\pm0.2)$.

17. An antenna according to claim 15, wherein the length of said vertical conductive strip of said second element is equal to or larger than $(\lambda\alpha/4)(1-0.2)$ where $\lambda$ is wavelength of transmitted or received radio wave and $\alpha$ is shortening coefficient of wavelength of glass, whilst the total length of said second element consisting of the length of said vertical conductive strip and the length of a portion of said horizontal conductive strip between said vertical conductive strip and said feed point portion is in the range of $(3\lambda\alpha/4)(1\pm 0.2)$.

18. An antenna according to claim 15, wherein the width of said horizontal conductive strip of said first element is in the range from 1 mm to 15 mm.

19. An antenna according to claim 15, wherein said third vertical conductive strip of said first element is connected to an end of said first horizontal conductive strip opposite to said end to which said first vertical conductive strip is connected, said feed point portion of said first element being located adjacent to said end of said first horizontal conductive strip to which said third vertical conductive strip is connected, said feed point portion of said second element being located adjacent to an end opposite to said end to which said vertical conductive strip is connected.

20. An antenna according to claim 19, further comprising an auxiliary element of an L-shape and having a horizontal conductive strip extended consecutively from said horizontal conductive strip of said second element.

21. An antenna according to claim 15, wherein said first element comprises a plurality of said first vertical conductive strips.

22. An antenna according to claim 21, further comprising a first auxiliary element of an L-shape and having a horizontal conductive strip extended consecutively from said one end of said horizontal conductive strip of said second element, and a second auxiliary element made up of a horizontal conductive strip and extended consecutively from another end of said horizontal conductive strip and extending side by side with said first horizontal conductive strip of said first element.

23. An antenna according to claim 15, wherein said third vertical conductive strip of said first element is connected to an end of said first horizontal conductive strip opposite to said end to which said first vertical conductive strip is connected, said feed point portion of said first element being located adjacent to said end of said first horizontal conductive strip to which said first vertical conductive strip is connected, said feed point portion of said second element being located adjacent to an end opposite to said end to which said vertical conductive strip is connected.

24. An antenna according to claim 15, being disposed in an open space between an upper edge of the window glass and a defogging heater element.

25. An antenna according to claim 15, being disposed in an open space between a lower edge of the window glass and a defogging heater element.

26. An antenna attached to a vehicle rear window glass, comprising:

a first element including a first horizontal conductive strip having a feed point portion, a first vertical conductive strip connected to an end portion of said first horizontal conductive strip, a second horizontal conductive strip connected at an end to said first vertical conductive strip and extending away therefrom to have another end, a second vertical conductive strip connected at an end to said another end of said second horizontal conductive strip and extending away therefrom to have another end adjacent said first horizontal conductive strip, and a third horizontal conductive strip connected to said another end of said second vertical conductive strip and extending away therefrom toward said first vertical conductive strip;

a second element consisting of a vertical conductive strip and a horizontal conductive strip connected to a lower end of said vertical conductive strip of said second element, said horizontal conductive strip of said second element having a feed point portion located adjacent to said feed point portion of said first horizontal conductive strip of said first element; and a coaxial cable having an inner conductor connected to one of said feed point portions of said first and second elements and an outer conductor connected to the other of said feed point portions of said first and second elements.

27. An antenna according to claim 26, wherein the length of one of said first and third vertical conductive strips of said first element remoter from said feed point portion of said first element is equal to or larger than $(\lambda\alpha/4)(1-0.2)$ where $\lambda$ is wavelength of transmitted or received radio wave and $\alpha$ is shortening coefficient of wavelength of glass, whilst the total length of said first element consisting of the length of said remoter one of said first and third vertical conductive strips and the length of a portion of said first horizontal conductive strip between said feed point portion and said remoter one of said first and third vertical conductive strips is in the range of $(3\lambda\alpha/4)(1\pm0.2)$.

28. An antenna according to claim 26, wherein the length of said vertical conductive strip of said second element is equal to or larger than $(\lambda\alpha/4)(1-0.2)$ where $\lambda$ is wavelength of transmitted or received radio wave and $\alpha$ is shortening coefficient of wavelength of glass, whilst the total length of said second element consisting of the length of said vertical conductive strip and the length of a portion of said horizontal conductive strip between said vertical conductive strip and said feed point portion is in the range of $(3\lambda\alpha4)(1\pm 0.2)$.

29. An antenna according to claim 26, wherein the width of said first horizontal conductive strip of said first element is in the range from 1 mm to 15 mm.

30. An antenna according to claim 26, wherein the width of said horizontal conductive strip of said second element is in the range from 1 mm to 15 mm.

31. An antenna according to claim 26, wherein said feed point portion of said first element is located adjacent to an end of said first horizontal conductive strip opposite to said end to which said first vertical conductive strip is connected, and said feed point portion of said second element is located adjacent to an end of said horizontal conductive strip of said second element opposite to said end of said horizontal conductive strip of said second element to which said vertical conductive strip is connected.

32. An antenna according to claim 31 further comprising an auxiliary element including a horizontal conductive strip and extended consecutively from said end of said horizontal conductive strip of said second element at which said feed point portion is located.

* * * * *